US008238777B2

(12) United States Patent
Kim et al.

(10) Patent No.: US 8,238,777 B2
(45) Date of Patent: Aug. 7, 2012

(54) DEVELOPING DEVICE AND ELECTROPHOTOGRAPHIC IMAGE FORMING APPARATUS INCLUDING THE DEVELOPING DEVICE

(75) Inventors: Jong-in Kim, Suwon-si (KR); Jai-il Choi, Suwon-si (KR); Dong-cheol Ahn, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 289 days.

(21) Appl. No.: 12/721,765

(22) Filed: Mar. 11, 2010

(65) Prior Publication Data

US 2011/0013925 A1 Jan. 20, 2011

(30) Foreign Application Priority Data

Jul. 20, 2009 (KR) ..... 2009-65889

(51) Int. Cl.
*G03G 15/00* (2006.01)

(52) U.S. Cl. ..... 399/90

(58) Field of Classification Search ..... 399/88, 399/89, 90

See application file for complete search history.

(56) References Cited

U.S. PATENT DOCUMENTS 6,029,019 A * 2/2000 Kawai ..... 399/90 X
6,508,601 B1 * 1/2003 Lui et al. ..... 399/90 X
7,844,198 B2 * 11/2010 Kuwabara et al. ..... 399/90 X
2001/0024581 A1 9/2001 Miyabe et al.
2005/0019061 A1 1/2005 Karakama et al.
2006/0045568 A1 3/2006 Kishi et al.

FOREIGN PATENT DOCUMENTS

EP 1363169 11/2003
JP 2001-201996 7/2001

OTHER PUBLICATIONS

Korean Notice of Allowance issued Aug. 3, 2011 in KR Application No. 10-2009-0065889.
Extended European Search Report issued Jan. 14, 2011 in EP Application No. 10158784.8.

* cited by examiner

*Primary Examiner* — Sandra Brase
(74) *Attorney, Agent, or Firm* — Stanzione & Kim, LLP

(57) ABSTRACT

A developing device detachably coupled to an electrophotographic image forming apparatus which includes a housing including a photoconductive drum and at least one roller; and an electrical contact member disposed in the housing, connected to the at least one roller, and formed of a conductive metallic plate to provide an electrical path between the at least one roller and a power supply when the developing device is attached to the electrophotographic image forming apparatus, wherein the electrical contact member includes a base including a coupling unit to engage with the housing, a first elastic member to bend from the base in a first direction; a second elastic member to bend from the first elastic member in a second direction and including a contact to contact the at least one roller; and an anti-deformation unit to bend from the base and to face a surface of the first elastic member in the second direction of the second elastic member to prevent the first elastic member from bending in the second direction.

17 Claims, 8 Drawing Sheets

DEVELOPING DEVICE AND ELECTROPHOTOGRAPHIC IMAGE FORMING APPARATUS INCLUDING THE DEVELOPING DEVICE

CROSS-REFERENCE TO RELATED APPLICATIONS

This application claims priority under 35 U.S.C. §119(a) from Korean Patent Application No. 10-2009-0065889, filed on Jul. 20, 2009, in the Korean Intellectual Property Office, the disclosure of which is incorporated herein in its entirety by reference.

BACKGROUND

1. Field of the Invention

The present general inventive concept relates to a developing device and an electrophotographic image forming apparatus including the developing device.

2. Description of the Related Art

Electrophotographic image forming apparatuses print an image onto a recording medium by irradiating light that has been modulated to correspond to image information onto a photoconductor in order to form an electrostatic latent image on a surface of the photoconductor. Toner is then supplied to the electrostatic latent image in order to develop the electrostatic latent image into a visible toner image. The toner image is then transferred and fixed onto the recording medium. Electrophotographic image forming apparatuses include a developing device which contains toner.

The developing device may be a cartridge including the photoconductor and the toner. The developing device may be attached to the electrophotographic image forming apparatus. The developing device includes rollers such as a charging roller and a developing roller to which a bias voltage is applied. The developing device includes an electrical contact member to electrically connect a power source disposed in a main body of the electrophotographic image forming apparatus with the charging and developing rollers. However, the electrical contact member fails to provide a stable electrical connection between the power source and the charging and developing rollers, which thereby adversely affects a reliability of the electrophotographic image forming apparatus and an image quality of a printed image.

SUMMARY OF THE INVENTION

The present general inventive concept provides a developing device including an electrical contact member capable of stably supplying a bias voltage to rollers of the developing device and an electrophotographic image forming apparatus including the developing device.

Additional aspects and/or utilities of the present general inventive concept will be set forth in part in the description which follows and, in part, will be obvious from the description, or may be learned by practice of the general inventive concept.

Exemplary embodiments of the present general inventive concept may be achieved by providing a developing device detachably coupled to an electrophotographic image forming apparatus, the developing device including a housing having a photoconductive drum and at least one roller and an electrical contact member disposed in the housing, connected to the at least one roller, and formed of a conductive metallic plate to provide an electrical path between the at least one roller and a power supply when the developing device is attached to the electrophotographic image forming apparatus, wherein the electrical contact member includes a base including a coupling unit to engage with the housing, a first elastic member to bend from the base in a first direction, a second elastic member to bend from the first elastic member in a second direction and including a contact to contact the at least one roller, and an anti-deformation unit to bend from the base and to face a surface of the first elastic member in the second direction to prevent the first elastic member from bending in the second direction.

The electrical contact member may be connected to a terminal of a conductive shaft of the at least one roller.

A bias voltage may be applied from the power supply to the terminal of the conductive shaft via the electrical path.

The first direction may correspond to a lengthwise direction of the at least one roller.

The second direction may traverse the first direction.

The anti-deformation unit may bend from the base in the first direction and may face an extension unit which extends from at least one of side of the first elastic member.

The housing may include a groove into which the electrical contact member is inserted in an insertion direction, and the extension unit may include a slope inclined in the insertion direction of the electrical contact member.

The coupling unit may be disposed in an arm which is bent from the anti-deformation unit.

The developing device may further include an elastic support member interposed between the second elastic member and the housing.

The contact may be in a shape of an embossing to protrude from the second elastic member toward the terminal of the shaft and having lengthwise and widthwise embossing components.

The roller may be a charging roller to charge the photoconductive drum to a uniform electric potential.

Exemplary embodiments of the present general inventive concept may also be achieved by providing an electrophotographic image forming apparatus including the developing device, an optical scanning unit to scan light modulated according to image information onto the photoconductive drum, a transfer unit to transfer a toner image formed on the photoconductive drum to a recording medium, and a fixing unit to fix the toner image on the recording medium via heat and/or pressure.

BRIEF DESCRIPTION OF THE DRAWINGS

The above and/or other features and utilities of the present general inventive concept will become more apparent by describing in detail exemplary embodiments thereof with reference to the attached drawings in which.

DETAILED DESCRIPTION OF THE EMBODIMENTS

Figure 1:
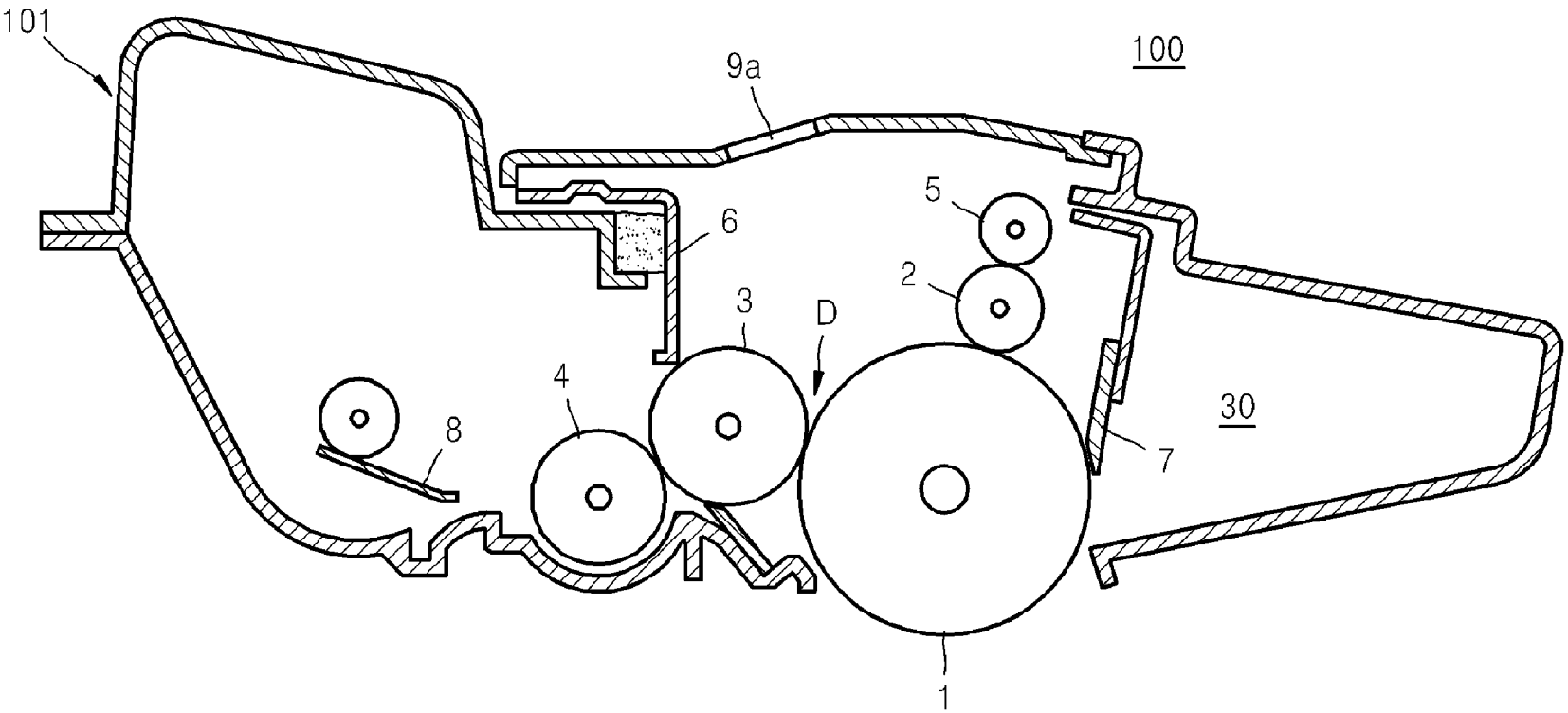
FIG. 1 is a schematic cross-sectional view illustrating a configuration of a developing device according to an exemplary embodiment of the present general inventive concept.

An electrophotographic image forming apparatus and a developing device according to the present general inventive concept will now be described more fully with reference to the accompanying drawings, in which exemplary embodiments of the present general inventive concept are illustrated.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

FIG. 1 is a schematic cross-sectional view illustrating a configuration of a developing device 100 according to an exemplary embodiment of the present general inventive concept. The developing device 100 may be an integrated cartridge including a photoconductive drum 1 and a developing roller 3. The developing device 100 may be attachable to and detachable from a main body of an electrophotographic image forming apparatus (700 of FIG. 9). That is, the developing device 100 may be detachably coupled to the main body 700 of the electrophotographic image forming apparatus 200.

The photoconductive drum 1 includes a photoconductive layer formed around an outer circumference of a cylindrically shaped metal pipe. A charging roller 2 may be in electrical communication with the photoconductive drum 1. In exemplary embodiments, the charging roller 2 may contact the photoconductive drum 1. When a charging bias voltage is applied to the charging roller 2, a surface of the photoconductive drum 1 is charged to a uniform potential. The developing roller 3 supplies toner contained in a housing 101 to an electrostatic latent image formed on the surface of the photoconductive drum 1 in order to develop the electrostatic latent image formed thereon. The electrophotographic image forming apparatus according to the present exemplary embodiment may use a contact developing technique in which the developing roller 3 and the photoconductive drum 1 contact each other to thereby form a development nip D. In this case, the developing roller 3 may include an elastic layer (not illustrated) formed around an outer circumference of a conductive metal core (not illustrated). When a developing bias voltage is applied to the developing roller 3, the toner is transferred via the development nip D to the electrostatic latent image formed on the surface of the photoconductive drum 1 and may be attached thereto. However, the present general inventive concept is not limited thereto. That is, in alternative exemplary embodiments, if a non-contact method is used, a surface of developing roller 3 and a surface of the photoconductive drum 1 may be spaced several hundred microns apart from each other.

The developing device 100 may further include a supply roller 4 that attaches the toner contained in the housing 101 to the developing roller 3. A supply bias voltage may be applied to the supply roller 4 in order to attach the toner to the developing roller 3. Reference numeral 5 denotes a cleaning roller to remove impurities and toner attached to the charging roller 2. Reference numeral 6 denotes a regulator to regulate an amount of toner attached to a surface of the developing roller 3 and supplied to the development nip D. Reference numeral 7 denotes a cleaning member to remove toner and impurities which remain on the surface of the photoconductive drum 1 before charging. The remaining toner and impurities removed from the surface of the photoconductive drum 1 by the cleaning member 7 may be stored in a waste-toner container 30.

In exemplary embodiments, an agitator 8 supplies the toner contained in the housing 101 to the developing roller 3. The agitator 8 may agitate the toner contained in the housing 101 to thereby frictionally charge the toner. FIG. 1 illustrates a single agitator, however the present general inventive concept is not limited thereto. That is, in alternative exemplary embodiments, the developing device 100 may include more agitators 8 to agitate and/or move the toner. The housing 101 may include an appropriate number of agitators in order to efficiently supply toner to the developing roller 3 in consideration of a capacity and a shape of the housing 101.

Figure 2:
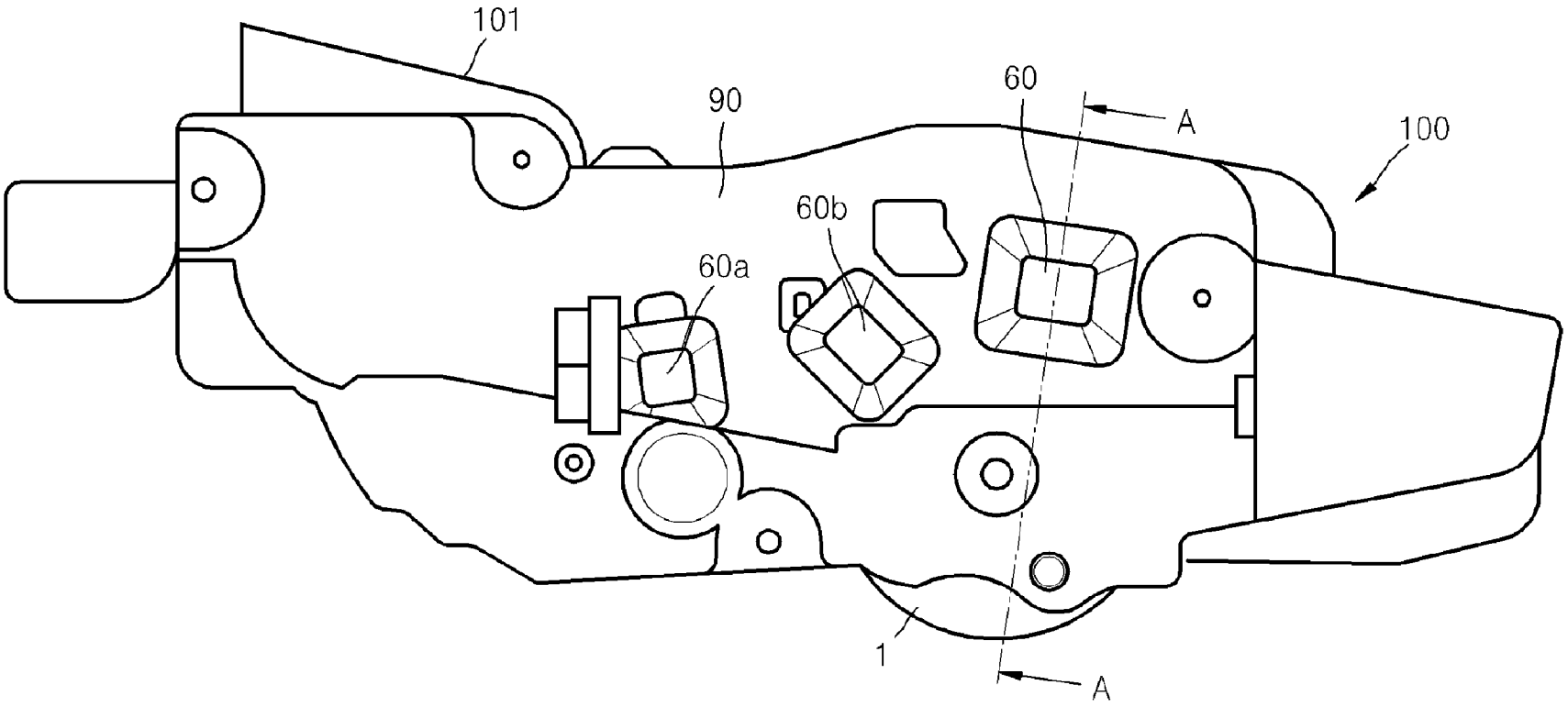
FIG. 2 is a side view of the developing device illustrated in FIG. 1 according to an exemplary embodiment of the present general inventive concept.
Figure 3:
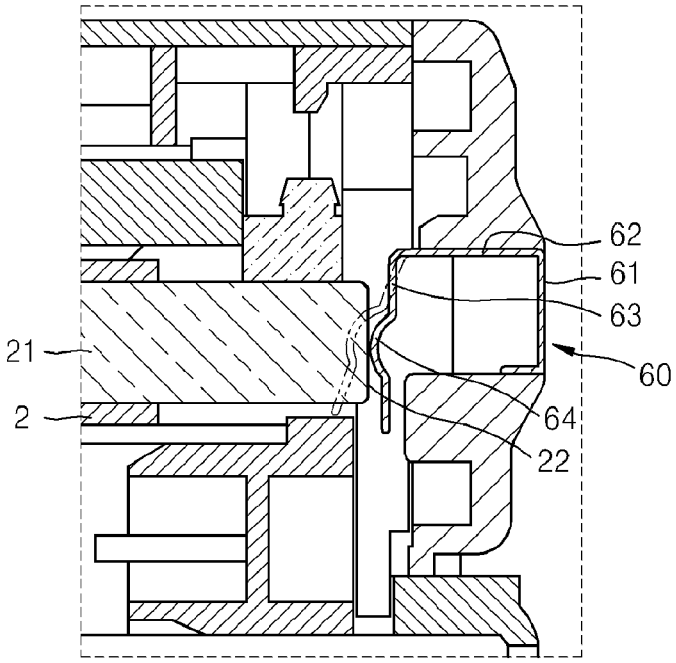
FIG. 3 is a cross-sectional view taken along line A-A' of FIG. 2 according to an exemplary embodiment of the present general inventive concept.
Figure 4:
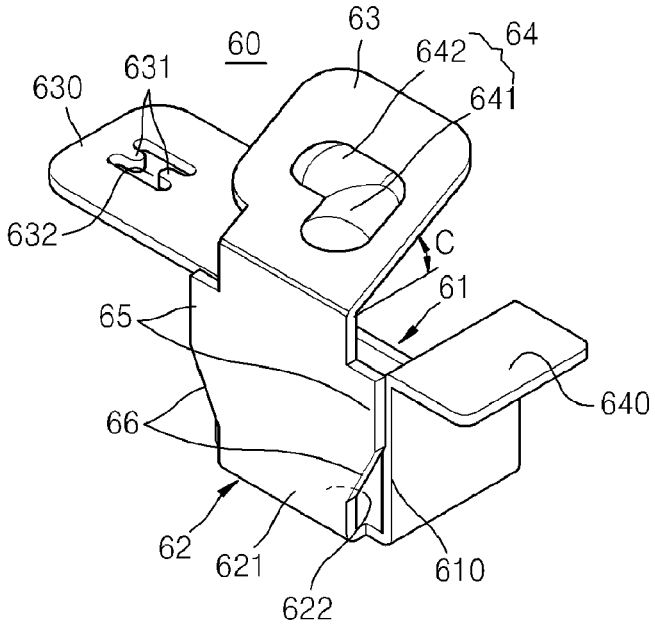
FIG. 4 is a perspective view of an electrical contact member according to an exemplary embodiment of the present general inventive concept.
Figure 5:
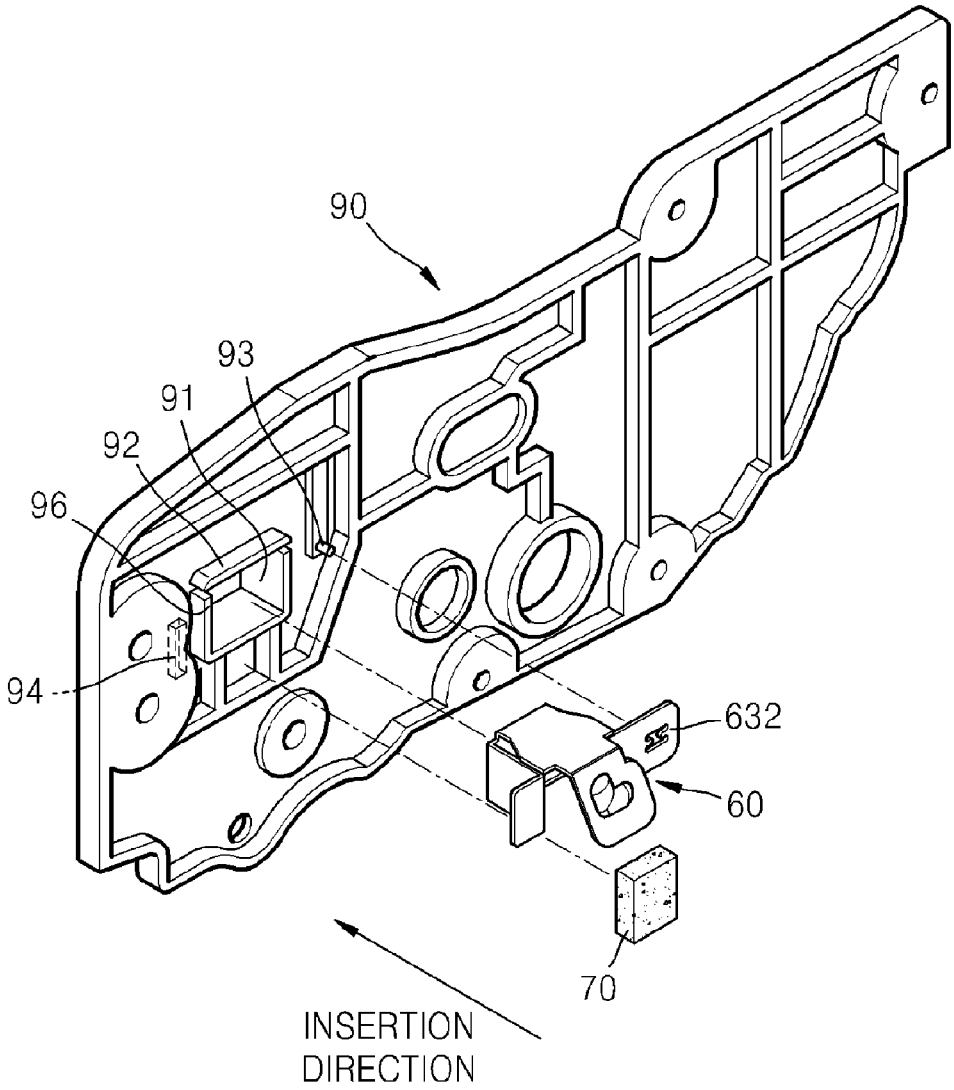
FIG. 5 is an exploded perspective view of an assembly between a side bracket and the electrical contact member of FIG. 4.

FIG. 2 is a side view of the developing device 100 illustrated in FIG. 1 according to an exemplary embodiment of the present general inventive concept. FIG. 3 is a cross-sectional view taken along line A-A' of FIG. 2 according to an exemplary embodiment of the present general inventive concept. FIG. 4 is a perspective view of an electrical contact member 60 according to an exemplary embodiment of the present general inventive concept. FIG. 5 is an exploded perspective view of an assembly between a side bracket 90 and the electrical contact member 60.

The charging bias voltage, the developing bias voltage, and the supply bias voltage are respectively applied to the charging roller 2, the developing roller 3, and the supply roller 4. For this, the developing device 100 includes an electrical contact member 60. When the developing device 100 is mounted on the main body of the electrophotographic image forming apparatus (700 of FIG. 9), a power terminal (not illustrated) connected to a power supply (not illustrated) of the main body (700 of FIG. 9) contacts a portion of the electrical contact member 60. Thus, the corresponding bias voltages may be applied to the charging roller 2, the developing roller 3, and the supply roller 4. Hereinafter, the electrical contact member 60 to apply the charging bias voltage to the charging roller 2 will be described. The electrical contact member 60 is bound to a side bracket 90 which forms a side of the housing 101. However, the present general inventive concept is not limited thereto. That is, in alternative exemplary embodiments, the electrical contact member 60 may be attached to various other components of the image forming apparatus 200 to provide electrical communication between the power supply and at least one of the charging roller 2, the developing roller 3, and the supply roller 4.

The electrical contact member 60 may be formed of a conductive and elastic metallic material. The electrical contact member 60 may be prepared by processing a metallic plate. The electrical contact member 60 includes an elastic member having a base 61 including a coupling unit engaged with the side bracket 90 and a contact 64 that is connected to the base 61 and may be in contact with a terminal 22 of a conductive shaft 21 of the charging roller 2. The elastic member also includes a first elastic member 62 which is bent from one edge of the base 61 in a lengthwise direction of the charging roller 2 (i.e., a first direction D1) and a second elastic member 63 which is bent from the first elastic member 62 in a direction which traverses the lengthwise direction of the charging roller 2 (i.e., a second direction D2). The second elastic member 63 includes the contact 64 which may be in contact with the terminal 22 of the conductive shaft 21. The contact 64 protrudes from a surface of the second elastic member 63 toward the terminal 22 of the shaft 21. In exemplary embodiments, the contact 64 may be formed via embossing. However, the present general inventive concept is not limited thereto. That is, in alternative exemplary embodiments, the contact 64 may be formed by various other methods or techniques to provide a feature that may be used to contact the terminal 22.

Referring to FIG. 5, the side bracket 90 includes a groove 91 in which the electrical contact member 60 is mounted. However, the present general inventive concept is not limited thereto. That is, in alternative exemplary embodiments, the coupling unit used to couple the electrical contact member 60 with the side bracket 90 may have various other shapes. In exemplary embodiments, as illustrated in FIG. 4, a first arm unit 630 of the base 61 of the electrical contact member 60 may include a slot 632 formed by inwardly protruding a pair of supporting pieces 631. The side bracket 90 may include a boss 93 that may be inserted into the slot 632. Space between the pair of the supporting pieces 631 is smaller than a diameter of the boss 93. As illustrated in FIG. 5, the side bracket 90 may include an insertion groove 94 (dotted line) into which a second arm unit 640 of the base 61 is inserted. After the second arm 640 of the electrical contact member 60 is inserted into the insertion groove 94, the electrical contact member 60 may be pressed such that the boss 93 is inserted into the slot 632 of the first arm unit 630. In exemplary embodiments, the supporting pieces 631 may be deformed in a direction opposite of an insertion direction of insertion of the boss 93, and ends of the supporting pieces 631 are supported by the boss 93 and thus the electrical contact member 60 is fixed on the side bracket 90. The first elastic member 62 of the electrical contact member 60 is inserted into the groove 91 of the side bracket 90.

Figure 11:
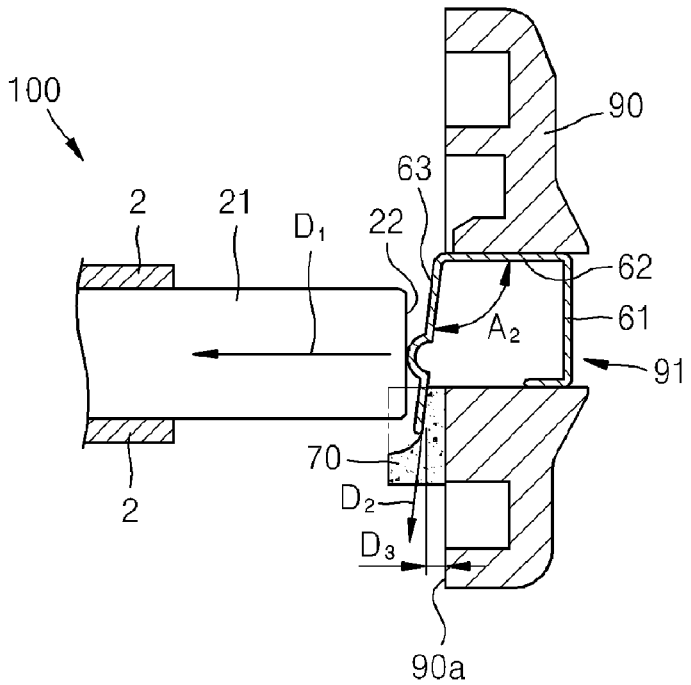
FIG. 11 is a cross-sectional view of the electrical contact member of FIG. 4 after insertion into the developing device according to an exemplary embodiment of the present general inventive concept.

In exemplary embodiments, if the side bracket 90 is engaged with the housing 101 when the electrical contact member 60 is mounted on the side bracket 90, the contact 64 contacts the terminal 22 of the shaft 21 of the charging roller 2, as illustrated in FIGS. 3 and 11. In this regard, the second elastic member 63 may be pushed by the charging roller 2, and thus an angle A1 (between the first elastic member 62 and the second elastic member 63) may elastically change, and an elasticity corresponding to the changed angle A2 may push the contact 64 toward the charging roller 2 to contact the contact 64 with the terminal 22 of the shaft 21.

Figure 8:
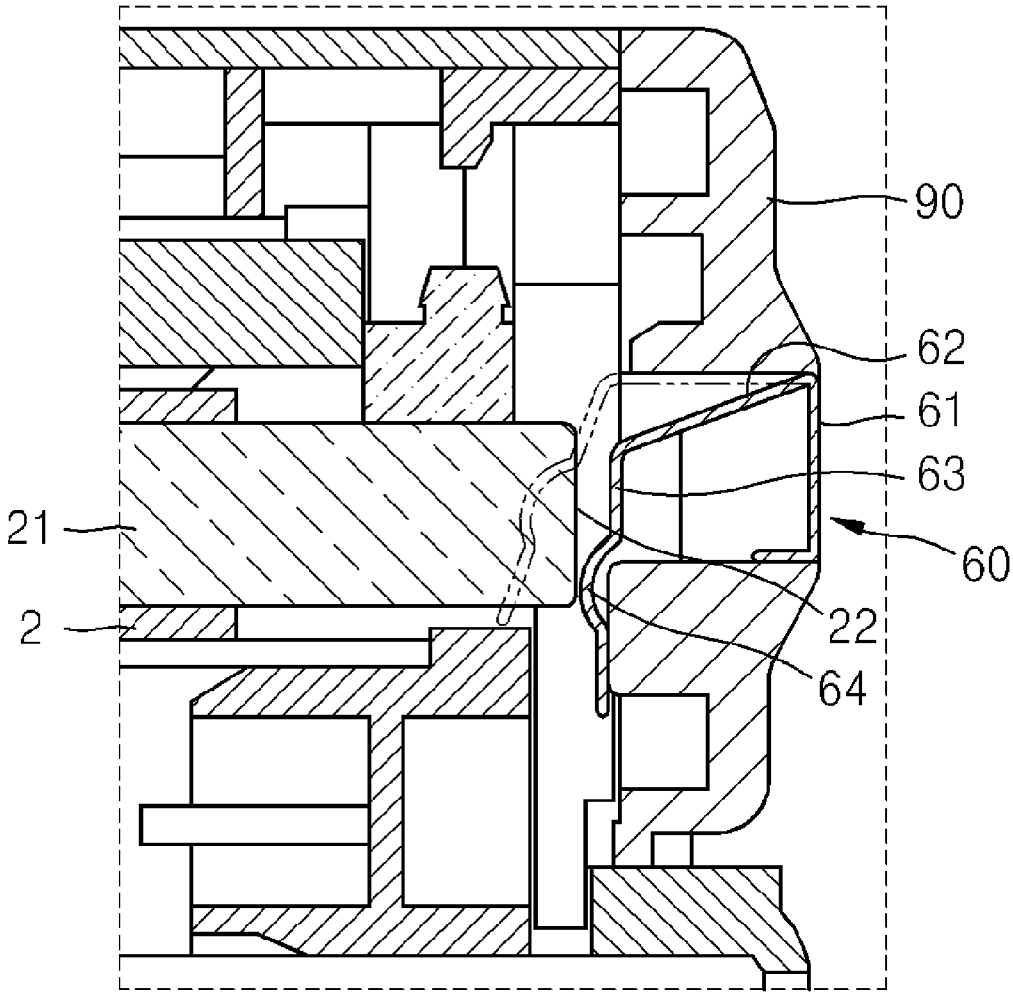
FIG. 8 is a cross-sectional view of a plastically-deformed first elastic member.

As illustrated in FIG. 8, if the first elastic member 62 is plastically-deformed by an external force, a contact force between the contact 64 and the charging roller 2 may be decreased, and thus the contact therebetween may not be stable. That is, if the first elastic member 62 undergoes plastic deformation, as illustrated in FIG. 8, the contact 64 may not provide sufficient force against the terminal 22 to provide a stable electrical connection between the contact 64 and the terminal 22 of the conductive shaft 21. If the degree of plastic deformation of the first elastic member 62 is larger than a predetermined level, the contact 64 may not contact the charging roller 2. Such plastic deformation may occur when the electrical contact member 60 is treated as a single piece. In addition, if the developing device 100 is in an assembled form, the charging roller 2 may push the electrical contact member 60 in a lengthwise direction of the charge roller 2 due to an impact caused by, for example, being dropped, such that the first elastic member 62 may be plastically-deformed in the second direction (i.e., the direction that the second elastic member 63 is bent in).

If the first elastic member 62 is plastically-deformed in a direction opposite of the bending direction of the second elastic member 63 before being assembled into the side bracket 90, the electrical contact member 60 may not be engaged with the groove 91 of the side bracket 90. Thus, it is easy to determine whether the electrical contact member 60 has been deformed during the assembling process. Plastic deformation of the developing device 100 caused by an impact after being assembled may occur since impact in the lengthwise direction of the charging roller 2 may be applied to the second elastic member 63. Since the second elastic member 63 is bent from the first elastic member 62 in a direction crossing the lengthwise direction of the charging roller 2, plastic deformation caused by the impact from the charging roller 2 may occur in the bending direction of the second elastic member 63. Furthermore, a first surface 621 of the first elastic member 62, which extends in a direction opposite of the bending direction of the second elastic member 63, may be supported by one side wall 92 of the groove 91 of the side bracket 90. Thus, plastic deformation of the first elastic member 62 in the bending direction of the second elastic member 63, i.e., change of the angle between the first elastic member 62 and the base 61, need to be controlled.

In exemplary embodiments, a difference between angel A1 and angle A2 (see FIGS. 10 and 11) may be controlled to prevent or substantially reduce a plastic deformation of the first and/or second elastic members 62 and 63.

Referring to FIG. 4, the base 61 includes an anti-deformation unit 610 which faces a second surface 622 of the first elastic member 62 in the bending direction of the second elastic member 63. In exemplary embodiments, one side or both sides of the first elastic member 62 may include an extension unit 65, and the anti-deformation unit 610 may face the extension unit 65. As illustrated in FIG. 4, the anti-deformation unit 610 may bend from the base 61 in the lengthwise direction of the charging roller 2. The anti-deformation unit 610 may be in contact with the second surface 622 of the first elastic member 62. However, the present general inventive concept is not limited thereto. That is, in alternative exemplary embodiments, the anti-deformation unit 610 may also be spaced apart from the second surface 622. The anti-deformation unit 610 contacts the second surface 622 of the first elastic member 62 when an impact is applied to the first elastic member 62 in the lengthwise direction of the charging roller 2 to thereby support the first elastic member 62 so as not to plastically-deform the first elastic member 62. According to this configuration, the plastic deformation of the first elastic member 62 in the bending direction of the second elastic member 63 caused while treating the electrical contact member 60 as a single piece or an assembled form or by the impact of the charging roller 2 may be prevented or substantially reduced. Since the anti-deformation unit 610 bends from the base 61, the plastic deformation of the first elastic member 62 may be regulated by controlling dimensions of the electrical contact member 60 without considering an assembly relationship between the developing device 100 and other components. That is, in exemplary embodiments, the anti-deformation unit 610 prevents or substantially reduces a movement of the second elastic member 63 along the second direction D2.

Figure 6:
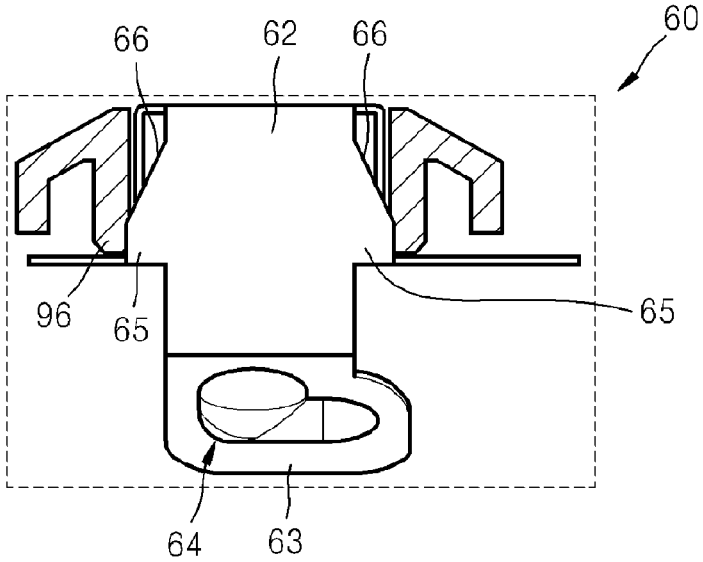
FIG. 6 is a cross-sectional view of an extension unit of the electrical contact member of FIG. 4 supported by a side wall of a groove according to an exemplary embodiment of the present general inventive concept.

In exemplary embodiments, the extension unit 65 may include a slope 66. As illustrated in FIGS. 5 and 6, the slope 66 may be inclined with respect to an insertion direction of the electrical contact member 60, such that the electrical contact member 60 may be easily inserted into the groove 91 of the side bracket 90. In addition, the extension unit 65 may be supported by the side walls 96 of the groove 91 of the side bracket 90, as illustrated in FIG. 6.

The first and second arm units 630 and 640 are bent from the anti-deformation unit 610, and a coupling unit is disposed in the first and second arm units 630 and 640 to rigidly support the anti-deformation unit 610 with respect to the side bracket 90. Thus, if the first elastic member 62 becomes plastically-deformed in the bending direction of the second elastic member 63 (i.e., the second direction D2), the anti-deformation unit 610 rigidly supports the second surface 622 of the first elastic member 62 to thereby prevent or substantially reduce plastic deformation of the first elastic member 62.

An impact from the charging roller 2 may plastically-deform the second elastic member 63. However, in exemplary embodiments, in order to prevent or substantially reduce deformation of the second elastic member 63 by the impact from the charging roller 2, strength in a lengthwise and a widthwise direction of the second elastic member 63 may be increased. For this, the contact 64 may be formed as an embossed feature having a lengthwise embossing component 641 and a widthwise embossing component 642. Accordingly, a bending strength in the lengthwise and widthwise directions of the second elastic member 63 may be increased.

Figure 7:
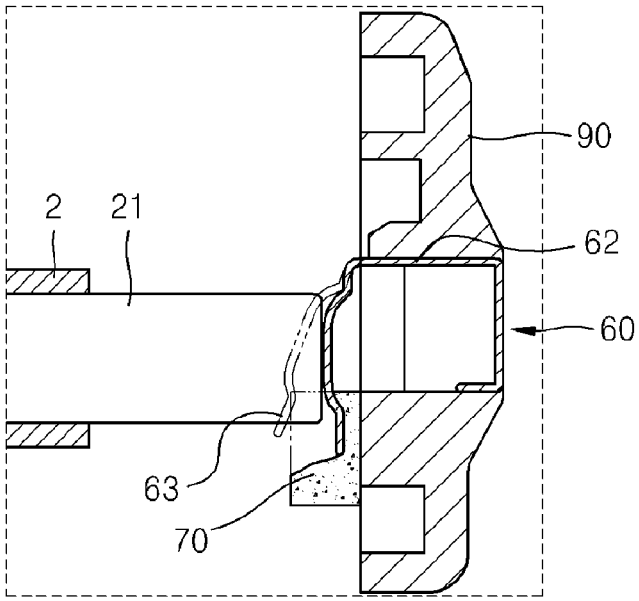
FIG. 7 is a cross-sectional view of a configuration of the developing device to prevent plastic deformation of a second elastic member according to an exemplary embodiment of the present general inventive concept.

As illustrated in FIG. 7, an elastic support member 70 to support the second elastic member 63 may be disposed in the side bracket 90. In exemplary embodiments, the elastic support member 70 may be disposed in between the side bracket 90 and at least a portion of the second contact member 63. The elastic support member 70 may be prepared by using an elastic material such as rubber, foam elastomer, and sponge. However, the present general inventive concept is not limited thereto. The elastic support member 70 may be disposed between the second elastic member 63 and the side bracket 90 to relieve an impact created from the charging roller 2 so that deformation of the second elastic member 63 is prevented or substantially reduced. In addition, after an impact from the charging roller 2 has ended, a resilience of the elastic support member 70 to restore the second elastic member 63 to an original position prevents the deformation of a bending angle C of the second elastic member 63.

In exemplary embodiments, the electrical contact member 60 is used to apply a charging bias voltage to the charging roller 2. However, the present general inventive concept is not limited thereto. That is, the electrical contact member 60 may be applied as electrical contact members 60*a* and 60*b* of FIG. 2 to respectively apply the developing bias voltage and the supply bias voltage to the developing roller 3 and the supply roller 4.

Figure 9:
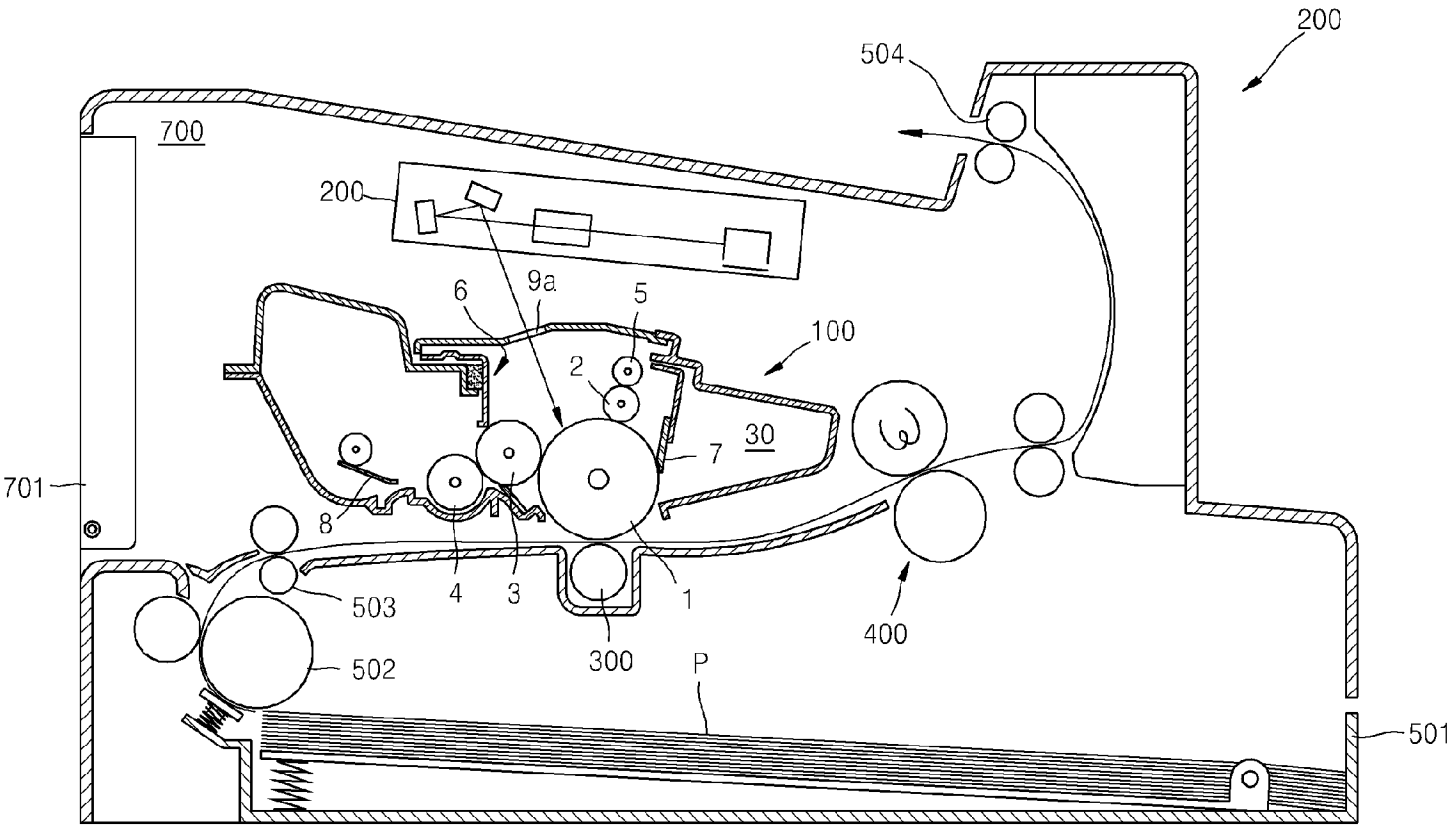
FIG. 9 is a schematic cross-sectional view illustrating a configuration of an electrophotographic image forming apparatus according to an exemplary embodiment of the present general inventive concept.

FIG. 9 is a schematic view illustrating a configuration of an electrophotographic image forming apparatus including the developing device illustrated in FIGS. 1 to 7. Referring to FIG. 9, the developing device 100 is mounted into the main body 700 of the electrophotographic image forming apparatus 200 through a door 701. Then, a power terminal (not illustrated) connected to a power supply (not illustrated) of the main body 700 contacts the electrical contact member 60 of the developing device 100.

An optical scanning unit 200 scans light that is modulated according to image information onto the photoconductive drum 1 that has been charged to a uniform potential. In exemplary embodiments, a laser scanning unit (LSU) that scans light emitted from a laser diode onto the photoconductive drum 1 by deflecting the light in a main scanning direction by using a polygon mirror may be used as the optical scanning unit 200.

A transfer roller 300, an example of a transfer unit, is disposed to face the surface of the photoconductive drum 1, and forms a transfer nip therebetween. A transfer bias voltage is applied to the transfer roller 300 so as to transfer a toner image developed on the surface of the photoconductive drum 1 to a recording medium P. However, the present general inventive concept is not limited thereto. That is, in alternative exemplary embodiments, a corona transfer unit may be used instead of the transfer roller 300.

The toner image transferred to the surface of the recording medium P by the transfer roller 300 remains adhered to a surface of the recording medium P due to an electrostatic attraction. A fixing unit 400 applies heat and/or pressure to fix the toner image to the recording medium P, thereby forming a permanent printed image on the recording medium P.

Figure 10:
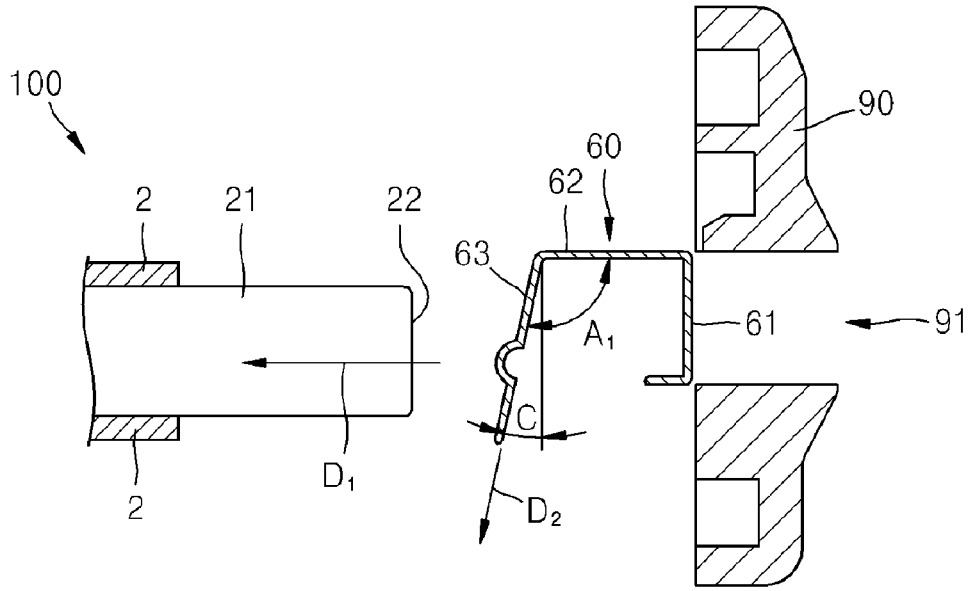
FIG. 10 is a cross-sectional view of the electrical contact member of FIG. 4 before insertion into the developing device according to an exemplary embodiment of the present general inventive concept.

FIG. 10 is a schematic cross-sectional view of the electrical contact member 60 of FIG. 4 before insertion into the developing device 100 and FIG. 11 is a schematic cross-sectional view of the electrical contact member 60 of FIG. 4 after insertion into the developing device 100.

In exemplary embodiments, the base 61 of the electrical contact member 60 may be inserted into the groove 91 of the side bracket 90 along the first direction D1. The first elastic member 62 may extend directly from the base 61 to apply a first force onto the side bracket 90. The second elastic member 63 may extend from the first elastic member 62 at a first angel A1 to provide a second force along the first direction D1.

In exemplary embodiments, the conductive shaft 21 of the charging roller 2 may be inserted into the developing device 100 along the first direction D1 so that the terminal 22 contacts the second elastic member 63. The conductive shaft 21 may apply a force onto the second elastic member 63 such that the first angel A1 is changed to a second angle A2.

In exemplary embodiments, an elastic support member 70 maintains a distance D3 between the second elastic member 63 and a surface 90*a* of the side bracket 90 and/or the angle A2 between the first and second elastic members 62 and 63 to thereby protect at least one of the first and second elastic members 62 and 63 from plastic deformation.

A method of forming an image using the electrophotographic image forming apparatus having the above configuration will now be briefly described. When a charging bias voltage is applied to the charging roller 2 through the electrical contact member 60, a surface of the photoconductive drum 1 is charged to a uniform potential. The optical scanning unit 200 scans light that is modulated according to image information onto the photoconductive drum 1 through an opening 9*a* of the developing device 100, thereby forming an electrostatic latent image on a surface of the photoconductive drum 1. Toner is transferred to the supply roller 4 via an agitator 8 and the supply roller 4 adheres the toner to a surface of the developing roller 3. A regulator 6 forms a toner layer having a uniform thickness on the surface of the developing roller 3. A developing bias voltage is applied to the developing roller 3. The toner is moved to the development nip D as the developing roller 3 rotates and is transferred and attached to the electrostatic latent image, which is formed on the surface of the photoconductive drum 1, due to the developing bias voltage, so that a visible toner image is formed on the surface of the photoconductive drum 1. A recording medium P picked up from a recording medium tray 501 by a pick-up roller 502 is transported to the transfer nip between the transfer roller 300 and the photoconductive drum 1 by a transporting roller 503. When a transfer bias voltage is applied to the transfer roller 300, the toner image formed on the photosensitive drum 1 is transferred to the recording medium P by an electrostatic attraction. The toner image transferred to the recording medium P is fixed to the recording medium P by being subjected to heat and/or pressure applied from the fixing unit 400, and thus, the printing is completed. The recording medium P is externally discharged by a discharge roller 504. Toner remaining on the surface of the photoconductive drum 1 which did not transfer to the recording medium P is removed by a cleaning member 7 and collected in a waste toner container 30.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims and their equivalents.

What is claimed is:

1. A developing device detachably coupled to an electrophotographic image forming apparatus, the developing device comprising:

a housing comprising:

a photoconductive drum; and at least one roller; and an electrical contact member disposed in the housing, connected to the at least one roller, and formed of a conductive metallic plate to provide an electrical path between the at least one roller and a power supply when the developing device is attached to the electrophotographic image forming apparatus, wherein the electrical contact member comprises:

a base comprising:

a coupling unit to engage with the housing;

a first elastic member to bend from the base in a first direction;

a second elastic member to bend from the first elastic member in a second direction and comprising a contact to contact the at least one roller; and an anti-deformation unit to bend from the base and to face a surface of the first elastic member in the second direction of the second elastic member to prevent the first elastic member from bending in the second direction.

2. The developing device of claim 1, wherein the electrical contact member is connected to a terminal of a conductive shaft of the at least one roller.

3. The developing device of claim 2, wherein a bias voltage is applied from the power supply to the terminal of the conductive shaft via the electrical path.

4. The developing device of claim 1, wherein the first direction corresponds to a longitudinal direction of the at least one roller.

5. The developing device of claim 1, wherein the second direction traverses the first direction.

6. The developing device of claim 1, wherein the anti-deformation unit bends from the base in the first direction and faces an extension unit which extends from at least one side of the first elastic member.

7. The developing device of claim 6, wherein the housing comprises a groove into which the electrical contact member is inserted in an insertion direction, and the extension unit comprises a slope inclined in the insertion direction of the electrical contact member.

8. The developing device of claim 6, wherein the coupling unit is disposed in an arm which is bent from the anti-deformation unit.

9. The developing device of claim 6, further comprising an elastic support member interposed between the second elastic member and the housing.

10. The developing device of claim 6, wherein the contact is in a shape of an embossing to protrude from the second elastic member toward the terminal of the shaft and having lengthwise and widthwise embossing components.

11. The developing device of claim 6, wherein the roller is a charging roller to charge the photoconductive drum to a uniform electric potential.

12. An electrophotographic image forming apparatus comprising:

the developing device of claim 1;

an optical scanning unit to scan light modulated according to image information onto the photoconductive drum;

a transfer unit to transfer a toner image formed on the photoconductive drum to a recording medium; and a fixing unit to fix the toner image on the recording medium via heat and/or pressure.

13. The electrophotographic image forming apparatus of claim 12, wherein the anti-deformation unit bends from the base in the first direction of the first elastic member and faces an extension unit which extends from at least one of side of the first elastic member.

14. The electrophotographic image forming apparatus of claim 13, wherein the coupling unit is disposed in an arm which bends from the anti-deformation unit.

15. The electrophotographic image forming apparatus of claim 13, further comprising an elastic support member disposed between the second elastic member and the housing.

16. The electrophotographic image forming apparatus of claim 13, wherein the contact is in an embossed shape to protrude from the second elastic member toward the terminal of the shaft and having lengthwise and widthwise components.

17. The electrophotographic image forming apparatus of claim 13, wherein the roller is a charging roller to charge the photoconductive drum to a uniform electric potential.

* * * * *